US006478449B2

(12) United States Patent
Lee et al.

(10) Patent No.: US 6,478,449 B2
(45) Date of Patent: Nov. 12, 2002

(54) LED BULB IN A WATER LAMP TUBE

(76) Inventors: Chun-Teng Lee, P.O. Box 7-820, Taipei (TW); Lin Te-Hui, P.O. Box 7-820, Taipei (TW)

( * ) Notice: Subject to any disclaimer, the term of this patent is extended or adjusted under 35 U.S.C. 154(b) by 0 days.

(21) Appl. No.: 09/829,561

(22) Filed: Apr. 11, 2001

(65) Prior Publication Data

US 2002/0149935 A1 Oct. 17, 2002

(51) Int. Cl.[7] ..... F21V 21/00

(52) U.S. Cl. ..... 362/249; 362/240; 362/226; 362/800

(58) Field of Search ..... 362/240, 249, 362/226, 800; 428/571

(56) References Cited

U.S. PATENT DOCUMENTS 3,504,169 A * 3/1970 Freeburger ..... 240/10
5,931,570 A * 8/1999 Yamuro ..... 362/800
6,157,117 A * 12/2000 Taylor ..... 313/318.01

* cited by examiner

*Primary Examiner*—Stephen Husar
*Assistant Examiner*—Guiyoung Lee

(57) ABSTRACT

An LED bulb in a water lamp tube is disclosed. Two light emitting chips in an LED are punched to trim the edges so that two correspondent light emitting pieces are left. A first pin and a second pin are spaced with a distance for positioning a combining plate. The two pins are cut so that the first pin is a smooth post; while a distal end of the second pin is extended to two sides like a T shape. By the aforesaid structure, the second pin of a bulb encloses the first pin of another bulb through 180 degrees; by repeating the process, many bulbs are connected in series so that the bulbs are conductive to each other. Alternatively, the first pin is extended to two sides like a T shape; while a distal end of the second pin is extended to two sides like a T shape. A lead is used to connect two bulbs and two ends of the conductive leads are enclosed by the T shape pins of second bulbs through 180 degrees. As a result, the light emitted is stable and the lifetime will be prolonged.

2 Claims, 7 Drawing Sheets

65

61
62
611
622
65

65

62
6
61
65

LED BULB IN A WATER LAMP TUBE

BACKGROUND OF THE INVENTION

1. Field of the Invention

The present invention relates to an LED bulb, and especially to LED bulb in a water lamp tube.

2. Description of the Prior Art

Currently, in a water lamp tube, general bulbs are implanted into a rubber tube. Since this bulbs must has a central shaft having two pins. A tungsten silk is connected between the two pins. The casing must be vacuumized so that no oxygen gas in the casing and thereby, light can be emitted. The structure is very complicated and the manufacture process is complex so that more time and hour are required. Furthermore, the tungsten silk is a short longer lifetime and the light from the tungsten is not stable. . The connections of the bulbs are performed by welding two legs extended from the bulb. Furthermore, the oxidization causes that the conductivity is not good and thus short circuit occurs. All these defects are necessary to be improved.

SUMMARY OF THE INVENTION

The main object of the present invention is to provide an LED bulb in a water lamp tube. Two light emitting chips in an LED are punched to trim the edges so that two correspondent light emitting pieces are left. A first pin and a second pin are spaced with a distance for positioning a combining plate. The two pins are cut so that the first pin is a smooth post; while a distal end of the second pin is extended to two sides like a T shape. By the aforesaid structure, the second pin of a bulb encloses the first pin of another bulb through 180 degrees; by repeating the process, many bulbs are connected in series so that the bulbs are conductive to each other.

Alternatively, the first pin is extended to two sides like a T shape; while a distal end of the second pin is extended to two sides like a T shape. A lead is used to connect two bulbs and two ends of the conductive leads are enclosed by the T shape pin through 180 degrees.

The various objects and advantages of the present invention will be more readily understood from the following detailed description when read in conjunction with the appended drawing.

DETAILED DESCRIPTION OF THE PREFERRED EMBODIMENT

Figure 1:
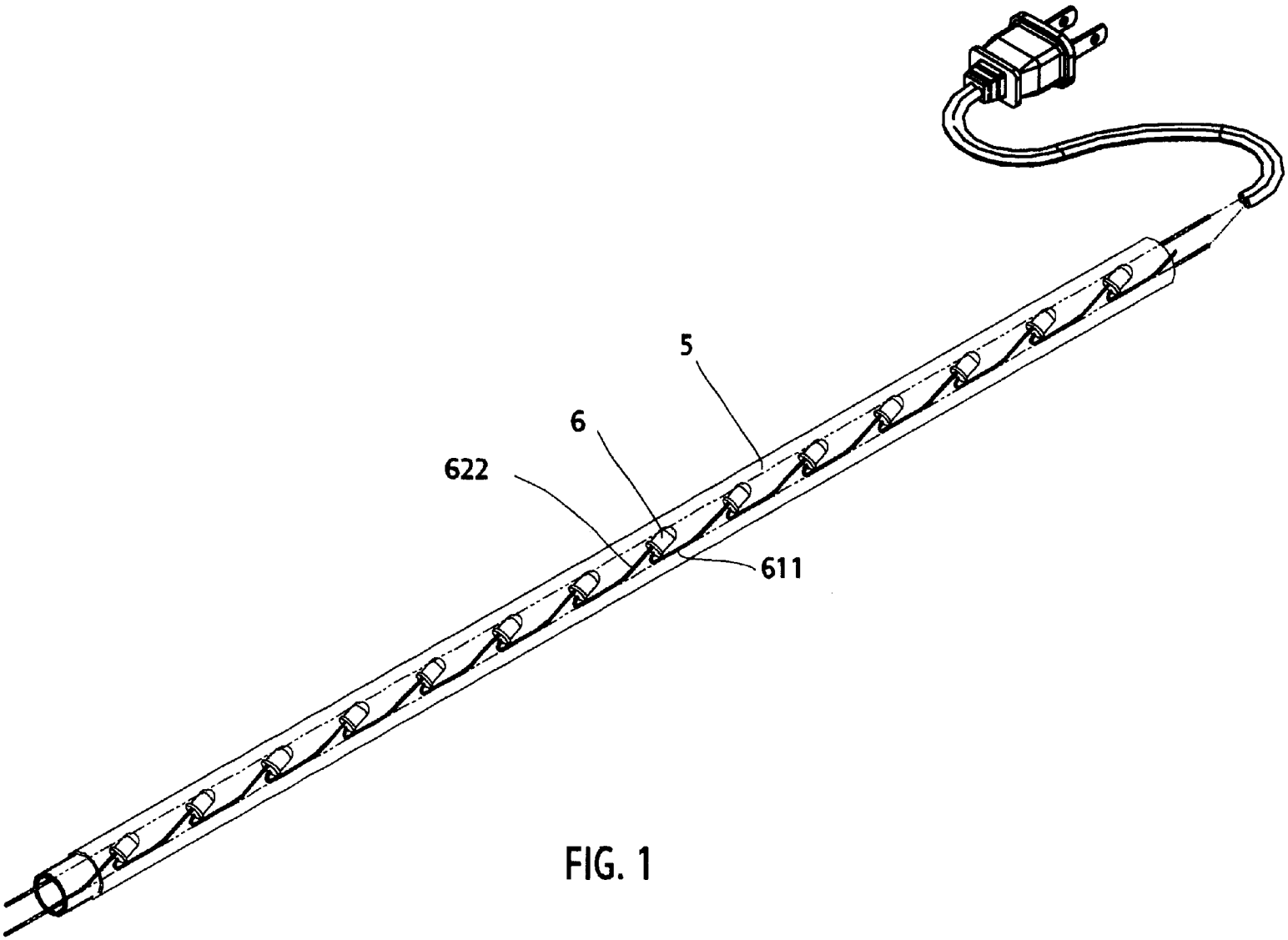
FIG. 1 is a schematic view showing the LED bulb in a water lamp tube of the present invention.
Figures 2A, 2B, 2C, 2D, 2E, 2F:
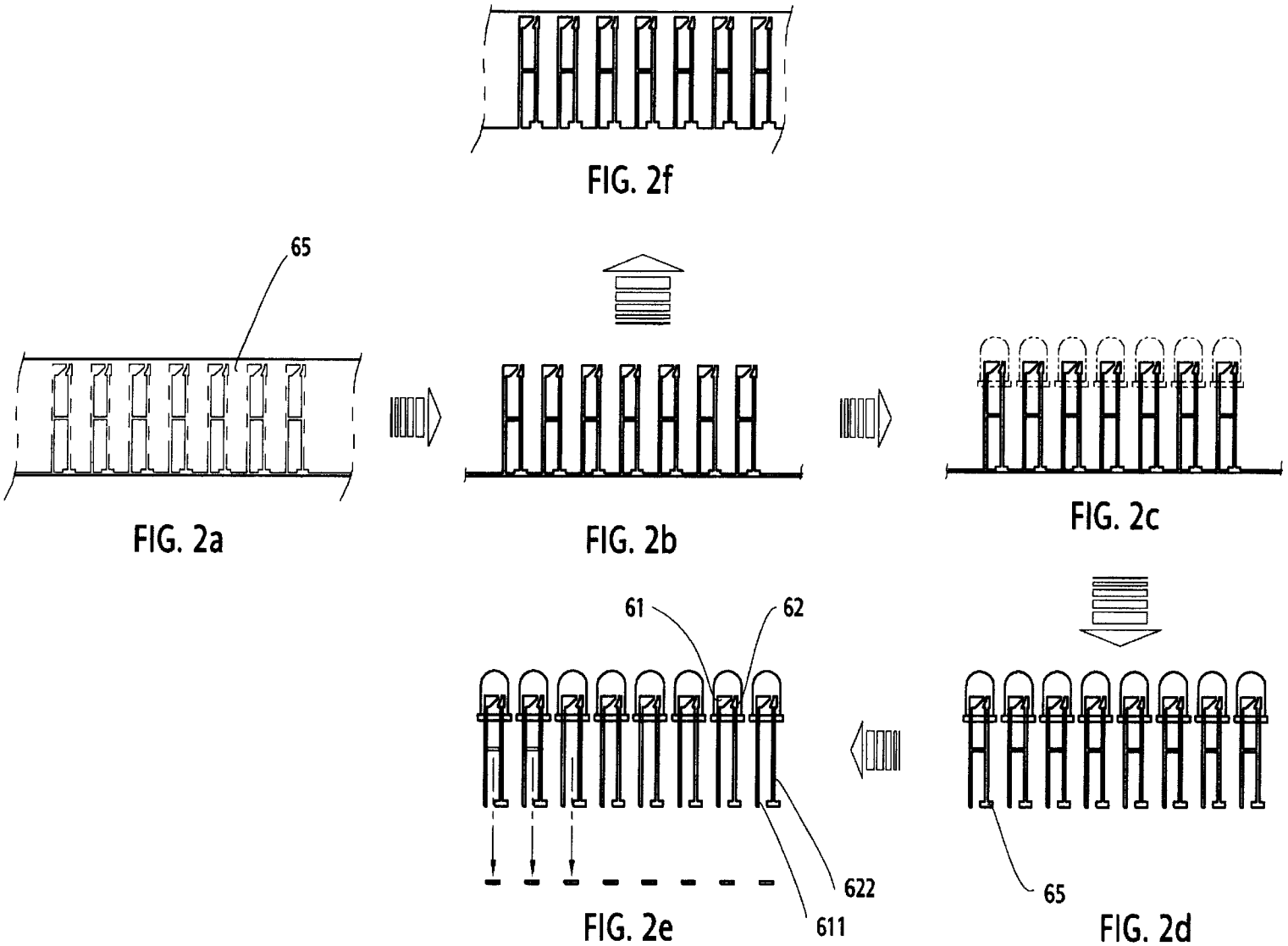
FIG. 2 is a schematic view showing the punching process of the LED bulb in a water lamp tube according to the present invention.

Referring to FIGS. 1 to 7, the LED bulb in a water lamp tube of the present invention is illustrated. In the structure, serial connected LED light emitting diodes 6 are implanted into a rubber tube 5. In a diode bulb, two light emitting chips are enclosed by resins and two pines are extended. In the LED. Two light emitting chips are punched to trim the edges so that two correspondent light emitting pieces 61 and 62 are left. Two pins are spaced with a distance for positioning a combining plate (not shown). As the light emitting chips are enclosed by resins through a high frequency combining process, then a bulb is formed. Namely, the combining plate of a pin is cut so that one pin 611 is a smooth post, while the distal end of another pin 622 is extended to two sides like a T shape 65.

Figure 3A:
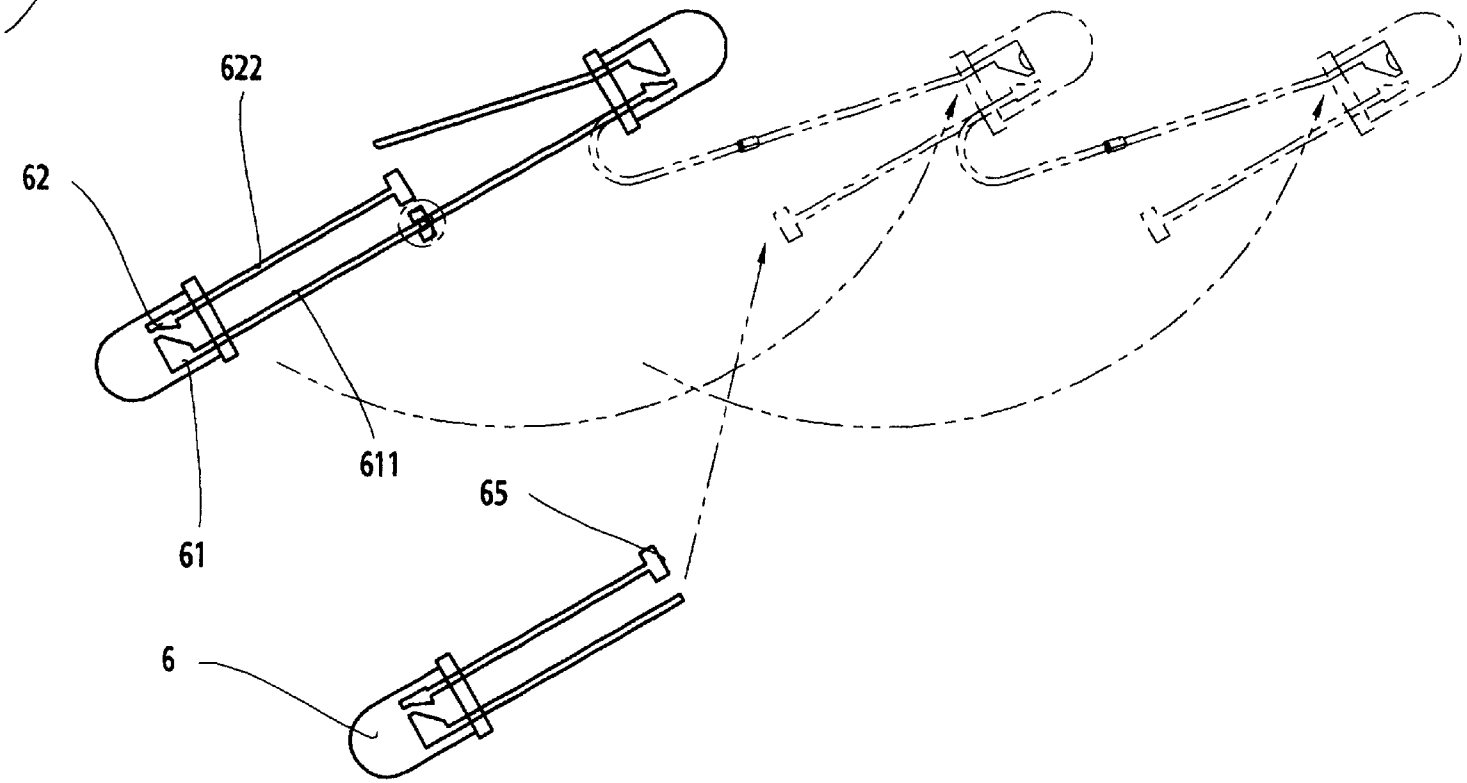
FIG. 3 is a schematic view showing the connection of the various bulbs according to the present invention.
Figure 3B:
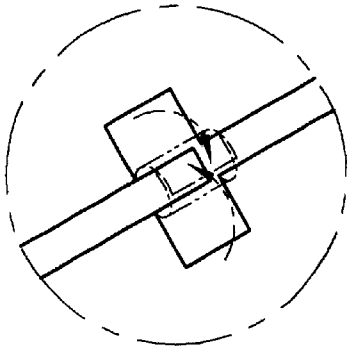
Figure 4B:
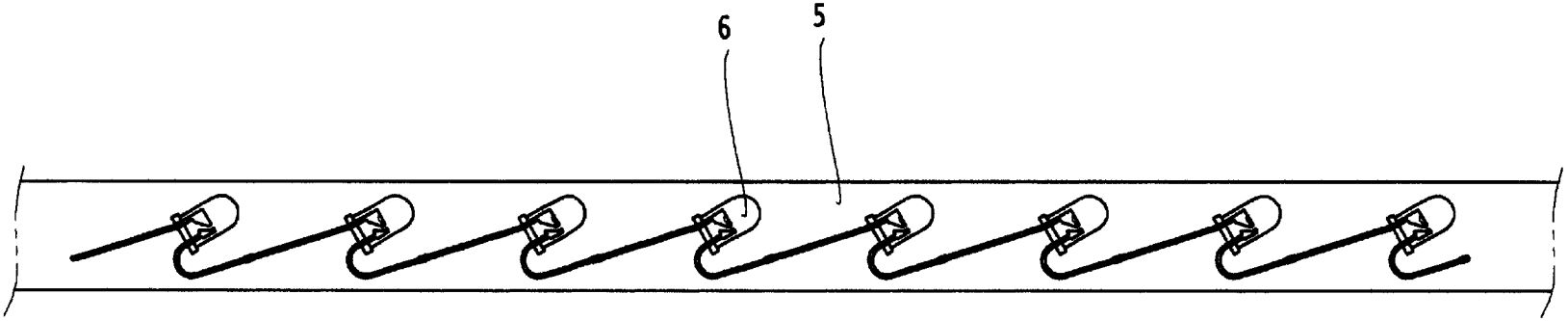
FIG. 4 is a schematic view showing the connections of the bulbs in the present invention.
Figure 4A:
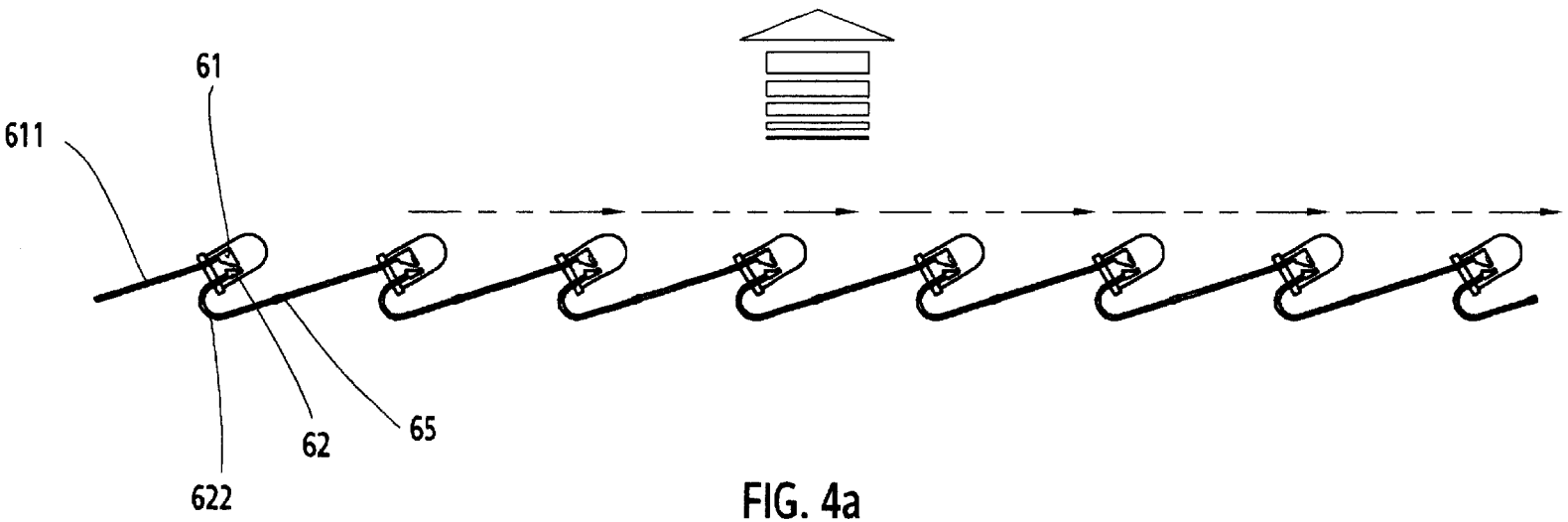
Figures 5A, 5B, 5C, 5D, 5E, 5F:
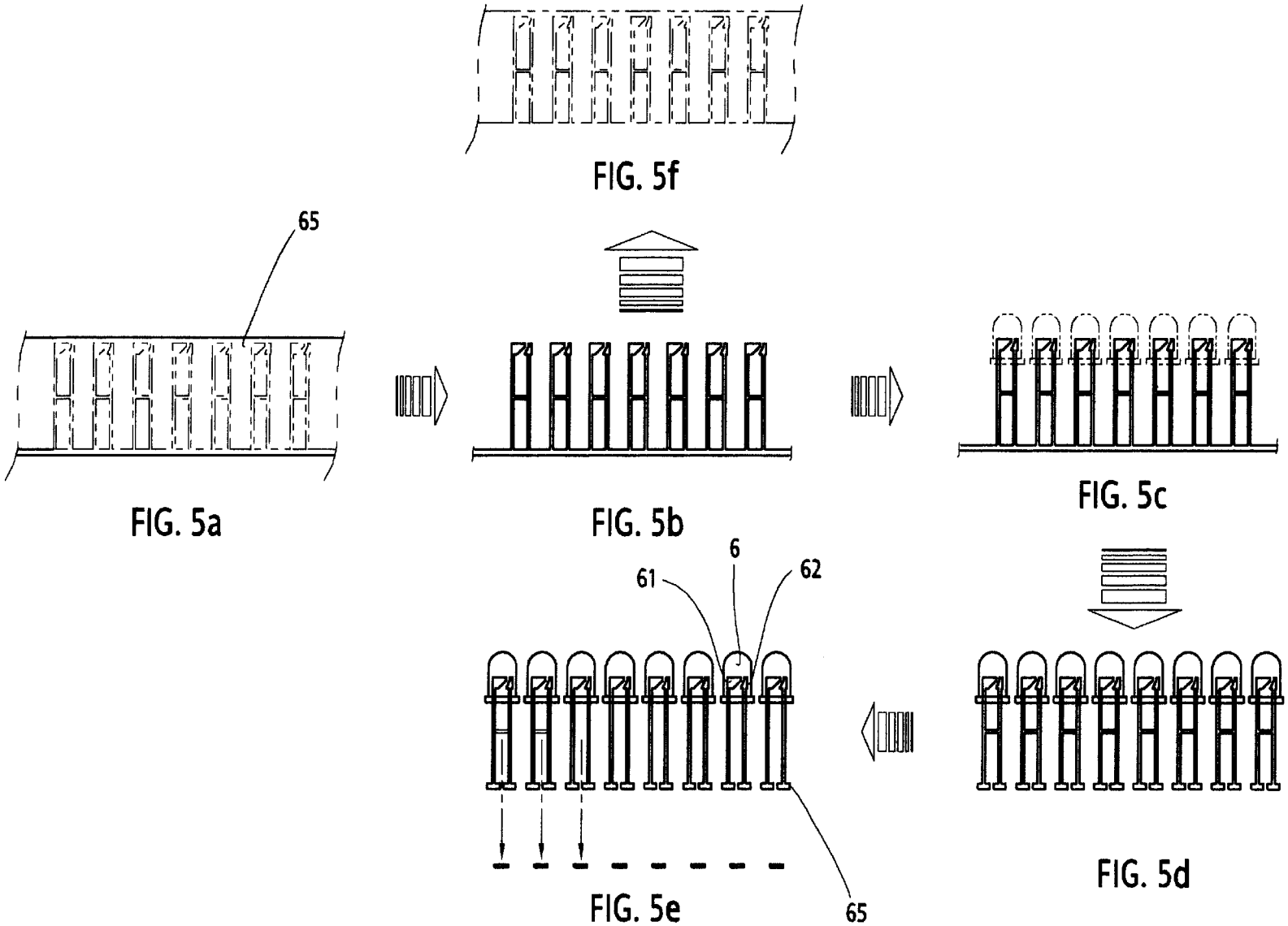
FIG. 5 shows the manufacturing of the LED bulb in a water lamp tube in another embodiment of the present invention.
Figure 6A:
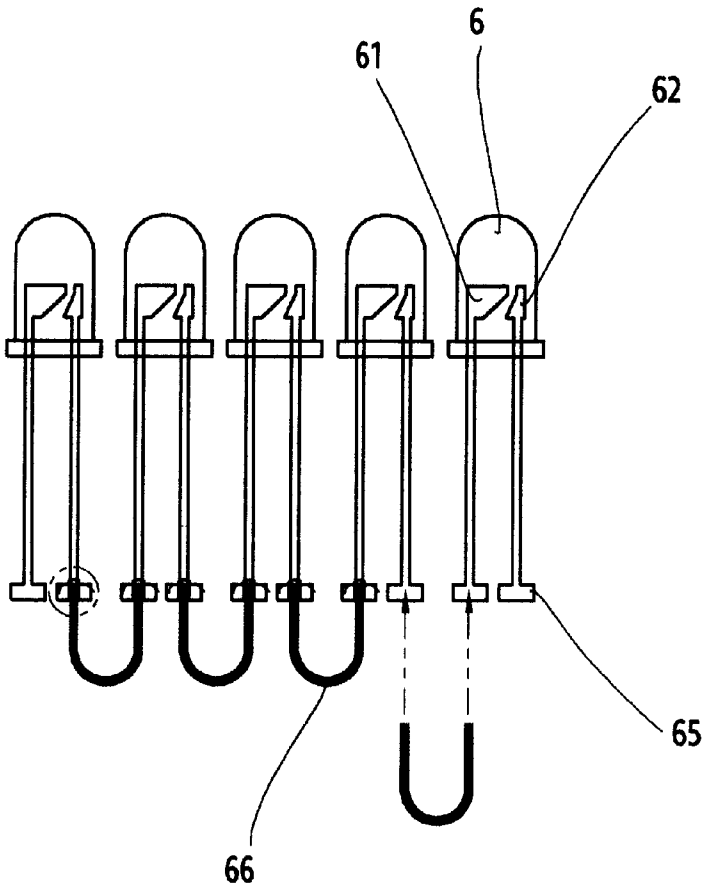
FIG. 6 shows the series connection in another embodiment of the present invention.
Figure 6B:
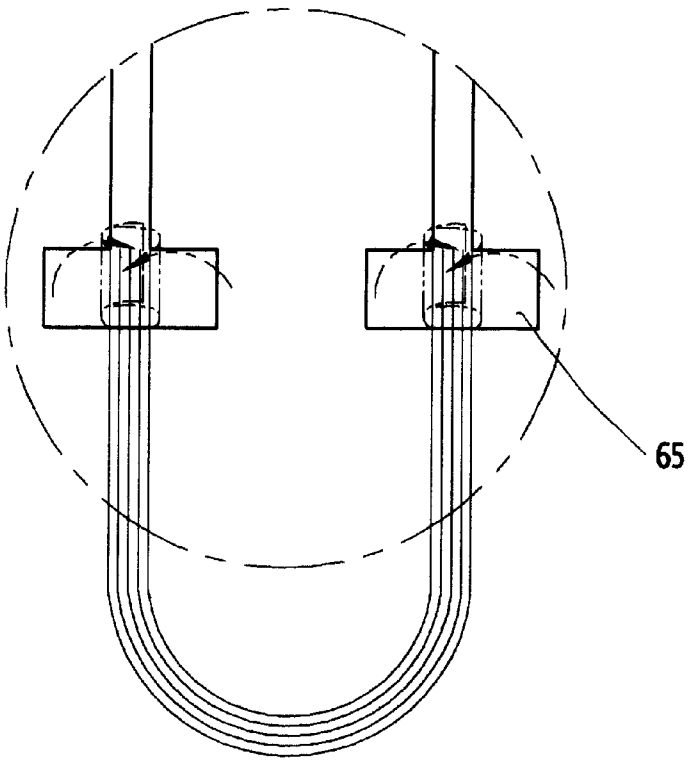
Figure 7B:
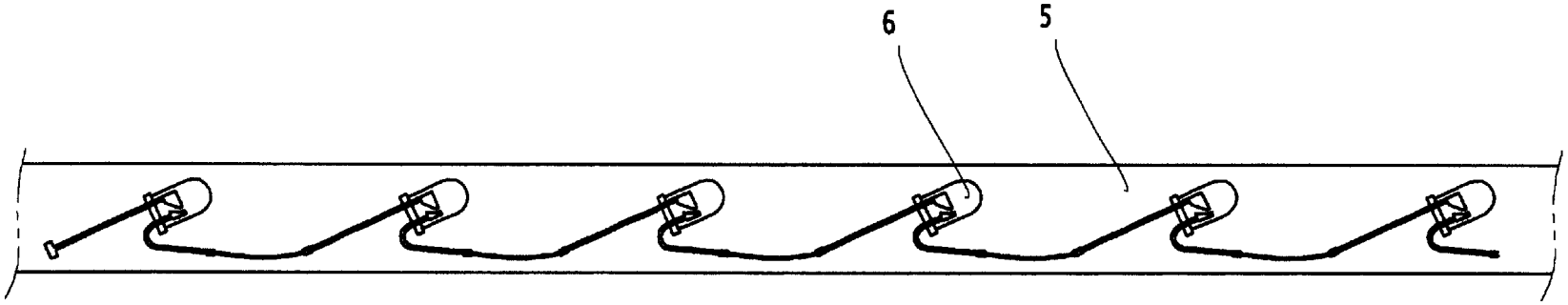
FIG. 7 shows another preferred embodiment of the present invention.
Figure 7A:
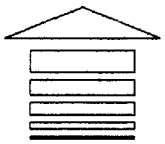
Figure 7A:
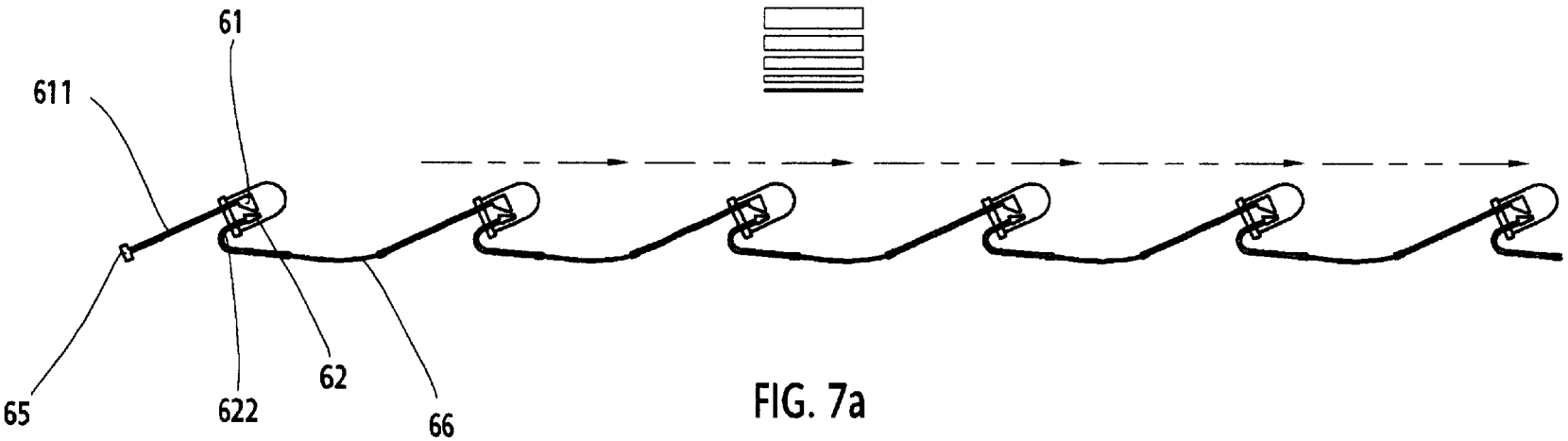

By the aforesaid structure, the pin 622 of a bulb can enclose the pin 611 of another bulb through 180 degrees as that shown in FIG. 3. By repeating the process, many bulbs can be connected in series so that the bulbs are conductive to each other. As a result, the bulbs have a longer lifetime. Another embodiment of the present invention is illustrated in FIG. 6. Each of the two pins of the bulb is designed as a T shape. Then a lead is used to connect two bulbs and two ends of the conductive leads are enclosed by the T shape pin through 180 degrees.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. An LED bulb in a water lamp tube, wherein two light emitting chips in an LED are punched to trim the edges so that two correspondent light emitting pieces are left; a first pin and a second pin are spaced with a distance; two pins are cut so that the first pin is a smooth post; while a distal end of the second pin is extended to two sides like a T shape;

wherein by the aforesaid structure, the second pin of a bulb encloses the first pin of another bulb through a winding of 180 degrees by the two sides extended from the distal end of the second pin; by repeating the process, many bulbs are connected in series so that the bulbs are conductive to each other.

2. An LED bulb in a water lamp tube, wherein two light emitting chips in an LED are punched to trim the edges so that two correspondent light emitting pieces are left; a first pin and a second pin are spaced with a distance; two pins are cut so that the first pin is extended to two sides like a T shape; while a distal end of the second pin is also extended to two sides like a T shape;

wherein a lead is bused to connect two bulbs and two ends of the conductive leads are enclosed by each adjacent side of two bulbs at the T shape portion of the second pin wind through 180 degrees.

* * * * *